US009879424B1

(12) United States Patent
Underkofler et al.

(10) Patent No.: US 9,879,424 B1
(45) Date of Patent: Jan. 30, 2018

(54) TORSION SPRING PANEL BARS AND CONSTRUCTION METHOD

(71) Applicant: USG Interiors, LLC, Chicago, IL (US)

(72) Inventors: Abraham M. Underkofler, Salem, WI (US); Peder J. Gulbrandsen, Aurora, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/615,928

(22) Filed: Jun. 7, 2017

(51) Int. Cl.
*E04B 9/00* (2006.01)
*E04B 9/10* (2006.01)
*E04B 9/06* (2006.01)

(52) U.S. Cl.
CPC ..... *E04B 9/006* (2013.01); *E04B 9/10* (2013.01); *E04B 2009/062* (2013.01); *E05Y 2600/40* (2013.01)

(58) Field of Classification Search
CPC ..... E04B 9/006; E04B 9/10; E04B 2009/062; E05Y 2600/40
See application file for complete search history.

(56) References Cited

U.S. PATENT DOCUMENTS 3,685,235 A * 8/1972 Lang ..... A47H 1/04 454/292
3,742,674 A * 7/1973 Lang ..... A47H 1/04 454/292
8,079,192 B2 * 12/2011 Gerkes ..... E04B 9/14 52/506.06
8,474,200 B2 * 7/2013 Gerkes ..... E04B 9/006 52/220.6
9,228,347 B2 1/2016 Underkofler et al.
2010/0095606 A1 * 4/2010 Bankston ..... E04B 9/061 52/83
2011/0219718 A1 * 9/2011 Gerkes ..... E04B 9/14 52/506.08
2012/0186175 A1 * 7/2012 Gerkes ..... E04B 9/006 52/220.6
2015/0345139 A1 * 12/2015 Underkofler ..... E04B 9/003 52/506.08

* cited by examiner

*Primary Examiner* — Rodney Mintz
(74) *Attorney, Agent, or Firm* — Pearne & Gordon LLP

(57) ABSTRACT

A suspended ceiling system comprising a plurality of spaced parallel main runners, a plurality of spaced parallel panel support bars intersecting and being fixed to the main runners at an oblique angle, a plurality of rhomboidal panels having angles equal to said oblique angle suspended from the bars, the panels having nominal width dimensions that are equal to or whole fractions of a distance between adjacent runners, the panels having opposed first edges extending perpendicularly to a direction in which a width of a panel is measured and opposed second parallel edges extending in a direction that is at said oblique angle relative to a direction that the first edges extend, the second panel edges underlying respective bars and having attached torsion springs received in slots formed in the bars.

11 Claims, 5 Drawing Sheets

TORSION SPRING PANEL BARS AND CONSTRUCTION METHOD

BACKGROUND OF THE INVENTION

The invention relates to suspended ceilings and, in particular, to systems employing torsion spring mounted panels.

PRIOR ART

Torsion spring mounted ceiling panels have generally been limited to use in systems in which a supporting grid and the panels themselves are rectangular. This convention has limited the look of ceiling installations to rectangular patterns. Architects, interior designers, building tenants and owners want distinctive ceiling treatments.

SUMMARY OF THE INVENTION

The invention provides a suspended ceiling system that affords a distinctive, non-rectangular geometric look. The system includes a suspension grid and complementary torsion spring supported rhomboidal panels. The inventive system allows the panels to be of most any rhomboid shape, equivalent in size to conventional ceiling panels, as specified by a designer. In the disclosed system, the grid has main runners or tees in parallel relation, typically spaced on four foot or two foot centers. Panel support bars extend between adjacent tees at a predetermined oblique angle. The disclosed bars can have a channel-shape cross-section with a lower web having slots for receiving torsion springs and locating tabs on edges of the panels. Flanges of the bar upstanding from the web have notched ends configured to fit over a tee flange while the web underlies the tee flange. This construction allows the bars, when being installed, to be supported on and slid along the respective tees to a desired location. Bar ends on opposite sides of a tee can be aligned by a bridge plate assembled over the top of a tee and abutted against the bar flange ends. The bars are fixed on the tees by screws assembled through the bar web ends and the overlying tee flange areas. Slots on the bars for receiving the panel torsion springs and locating tabs of adjacent panels are offset or staggered in accordance with the invention to accurately locate the panel edges along straight sight lines.

DESCRIPTION OF THE PREFERRED EMBODIMENT

Figure 1:
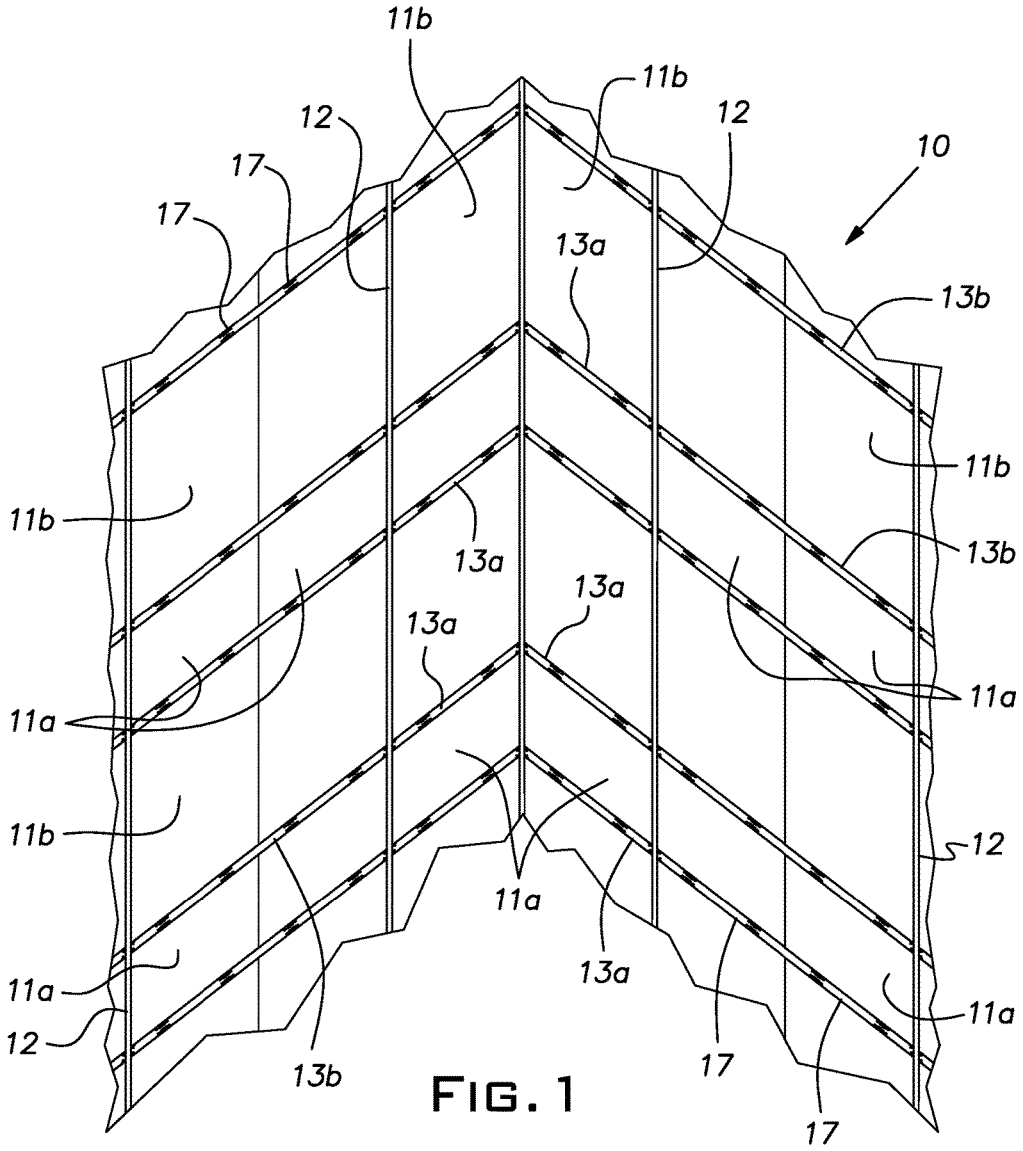
FIG. 1 is a somewhat schematic plan view of a portion of a chevron shaped ceiling construction employing the invention.

FIG. 1 illustrates a suspended ceiling 10 employing rhomboidal panels 11*a*, 11*b* arranged in a chevron pattern. As shown, the panels 11*a*, 11*b* can be of different size and can be of right or left hand shape. The panels 11 are suspended on a grid of parallel tees or runners 12 and parallel bars 13*a*, 13*b* obliquely intersecting the tees 12. Where the panels 11 form of a chevron pattern, the bars, like the panels 11, are provided in symmetrical right and left hand versions.

The tees 12 can be conventional suspended ceiling main tees or runners well known in the industry. The bars 13 are unique and their geometry will depend on the acute angle selected for the rhomboid shape of the panels 11. In the illustrated case, the acute angle has been selected to be 52 degrees.

Figure 4:
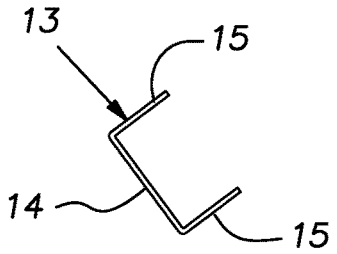
FIG. 4 is a cross-sectional view typical of the bars of FIGS. 2 and 3.

In the disclosed arrangement, the elongated bars 15 are provided in two different lengths. The shorter bar being designated 13*a* and the longer bar being designated 13*b*. The illustrated bars 13 are formed as sheet metal channels that are installed hollow side up. FIG. 4 illustrates a typical cross-section of a bar 13 shown with a horizontal web 14 and upstanding flanges 15 extending vertically from longitudinal margins of the web 14.

Figure 2:
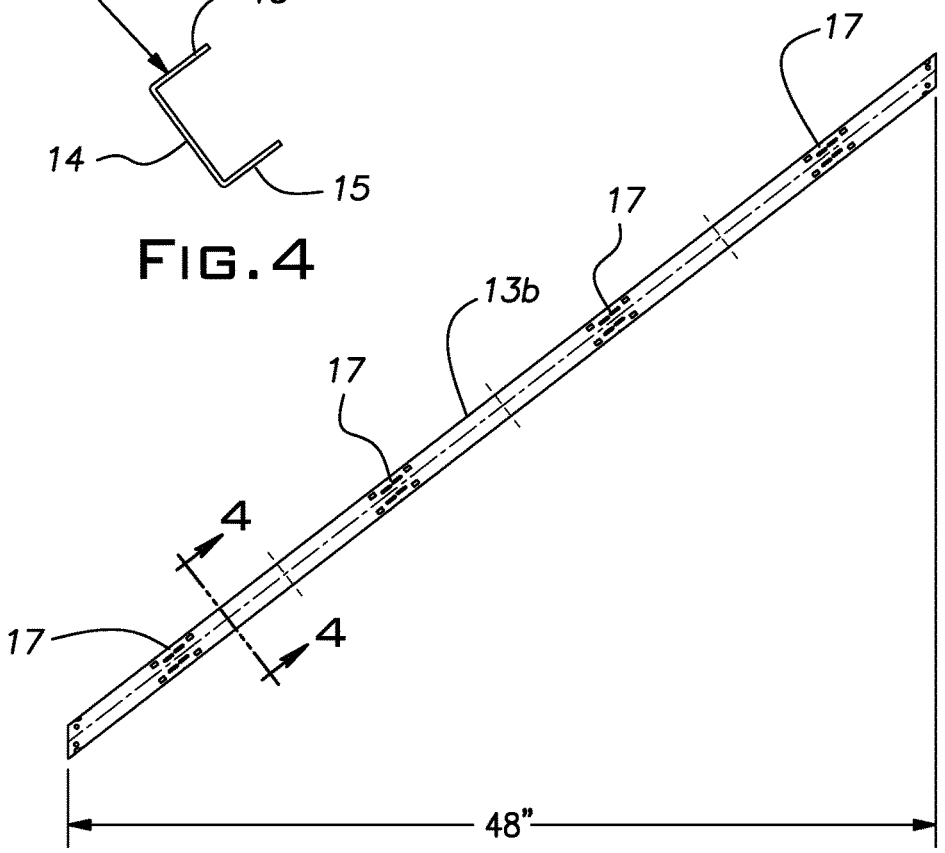
FIG. 2 is a plan view of a long right hand bar used in the grid of FIG. 1.
Figure 3:
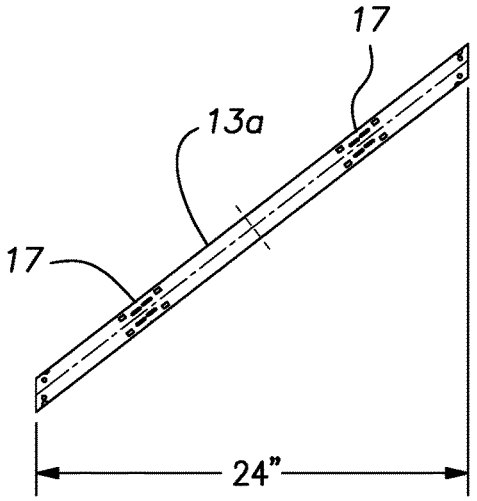
FIG. 3 is a plan view of a short right hand bar used in the grid of FIG. 1.

FIGS. 2 and 3 illustrate right hand versions of the bars 13. The longer bars 13*b* have four torsion spring locations 17 and the short bars 13*a* have two torsion spring locations 17. Where the main tees 12 have a nominal center-to-center spacing of four foot, the longer bars 13*b* have a length of about 60.4 inches so that at a 52 degree angle relative to the tees, they will span between two adjacent tees. Similarly, the shorter bars 13*a* with nominal lengths of about 30.3 inches and 52 degree orientations span between tees 12 on two foot centers. Left hand versions of the bars 13 are symmetrical and have the same dimensions.

Figure 6:
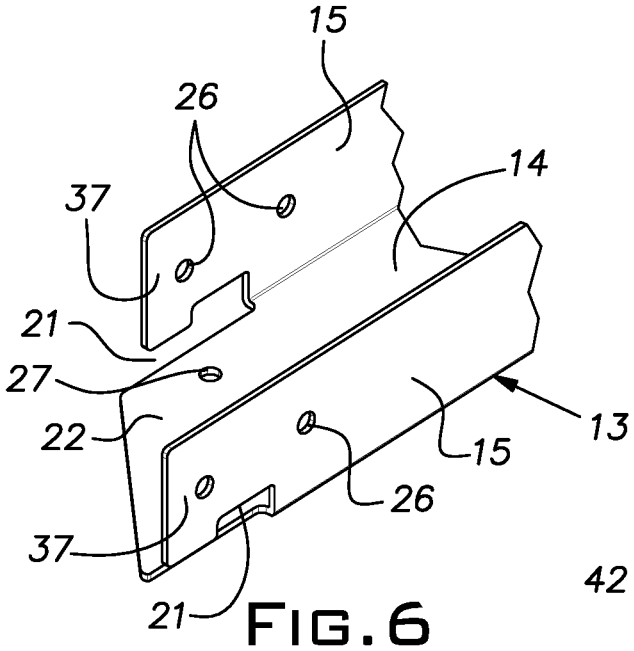
FIG. 6 is a perspective view of an end typical of the bars.

A typical end construction of a bar 13 is illustrated in FIG. 6. Material is removed at the juncture of the web 14 and flanges 15 to form a clearance slot 21 at the end of each flange and to form a cantilevered tongue area 22. The clearance slot 21 is widened at an inner part for clearance of a conventional hem 23 (FIG. 12) on a flange 24 of a tee 12. Holes 26, 27 are punched in the flanges 15 and tongue 22 for fixing a bar 13 in an installed position as described below.

Torsion springs 31 (FIG. 11) and associated locating tabs 32 of a ceiling panel 11 are received in respective apertures or slots 56, 57 (FIG. 5) punched in the bar web 14 at spring locations 17 indicated in FIGS. 2 and 3.

Figure 12:
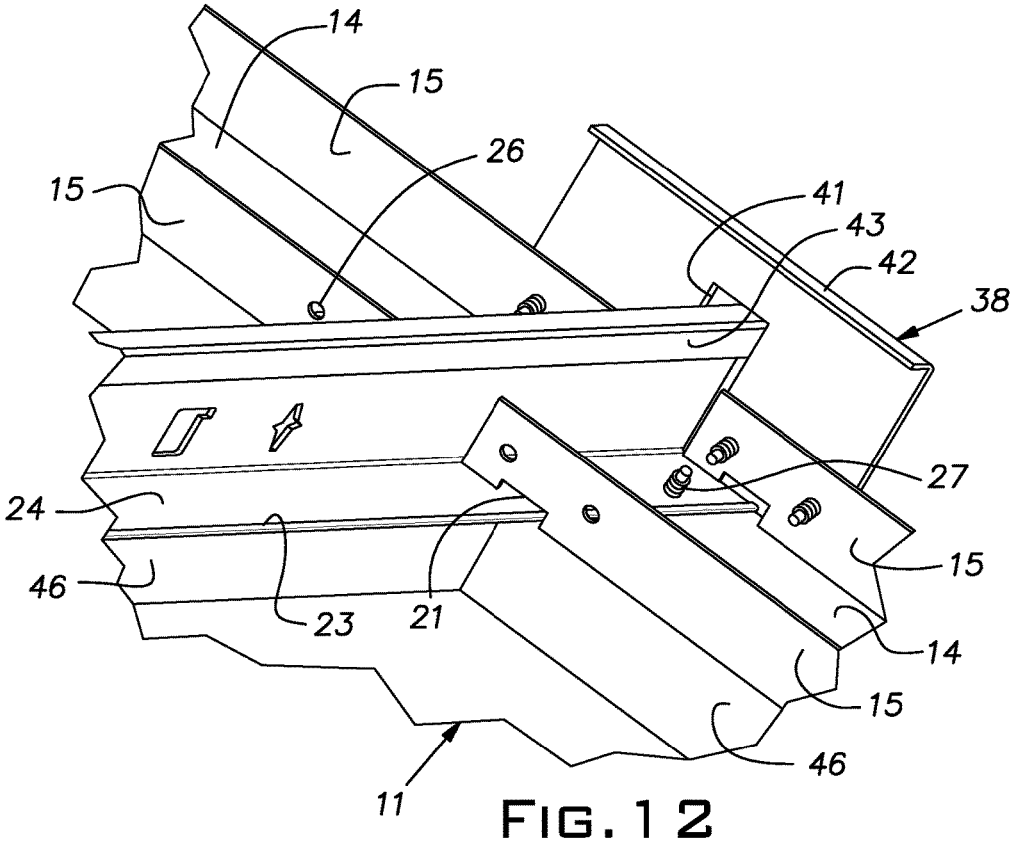
FIG. 12 is a perspective view of two bar ends intersecting a main tee from opposite sides and aligned with the splice plate.
Figure 13:
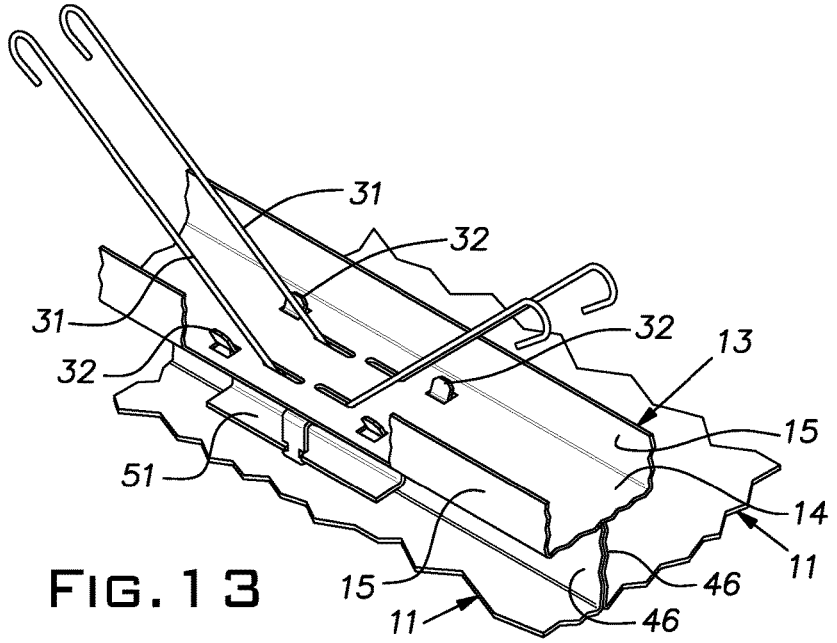
FIG. 13 is a perspective fragmentary view of two adjacent panels and their torsion springs at a spring center of a common bar.

A bar 13 is installed on a pair of adjacent tees 12 by locating flange end portions 37 over the tee flange 24 (FIG. 12). The bar flange portions 37 can support the bars 13 on the tees 12 and allow the bars 13 to slide on the tee flanges 24 until they are in a desired position.

Figure 7:
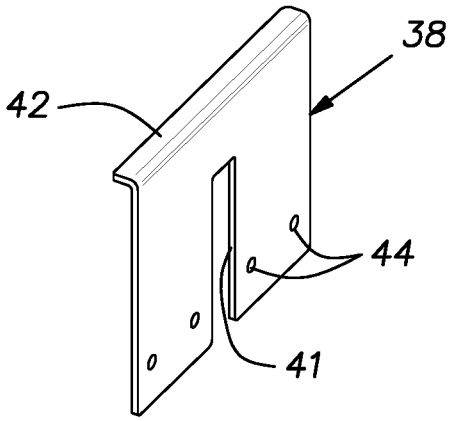
FIG. 7 is a perspective view of a bar splice plate.

As depicted in FIG. 12, the bar 13 on opposite sides of a tee 12 can be mutually aligned with a bridging splice plate 38 (FIG. 7). The plate 38 is preferably a sheet metal stamping with a central slot 41 open at a bottom edge and a stiffening flange 42 at a top. The slot 41 provides clearance for an upper reinforcing bulb 43 of a tee 12. The plate 38 has preformed holes 44 for screws used to attach the plate to the flanges 15 of the bars 13 being aligned. The plate 38 is abutted and fixed with screws against flanges 15 of the pair of bars 13 being aligned. A bar 13, once properly located on a tee 12 is fixed in position by driving screws through holes 27 in the bar tongue 22 into the overlying flange 24 of the supporting tee 12.

Figure 8:
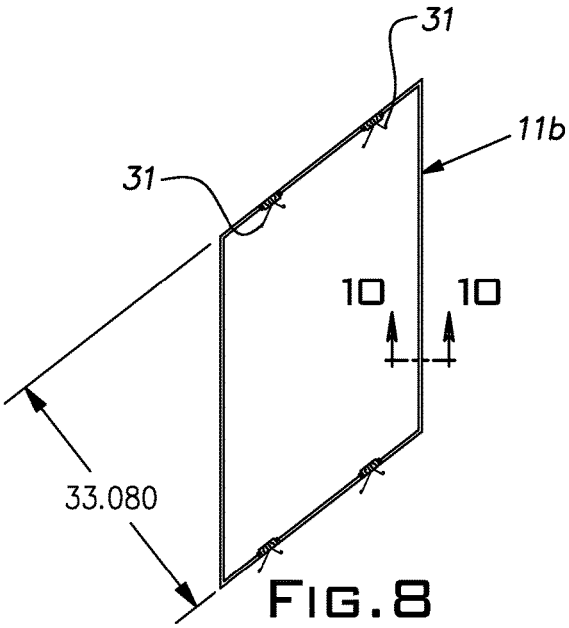
FIG. 8 is a plan view of a large right hand panel.
Figure 9:
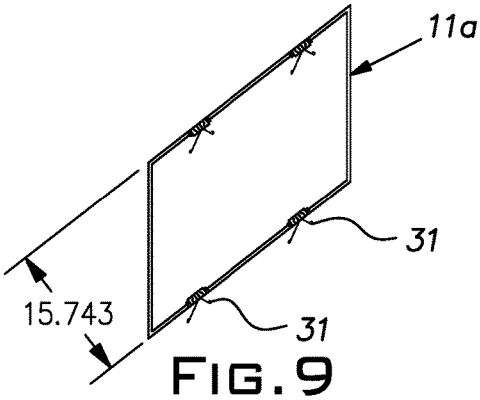
FIG. 9 is a plan view of a small right hand panel.

FIGS. 8 and 9 illustrate two examples of right hand rhomboid panels, both being nominally 24 inches wide. The smaller panel 12*a* measures 15.743 inches between two sides that extend obliquely to the 24 inch width and the large panel 12*b* measuring nominally 42 inches on two sides extending perpendicularly to the 24 inch width. For a chevron ceiling design such as shown in FIG. 1, both right and left hand symmetrical panels 11 and bars 13 are utilized.

Figure 10:
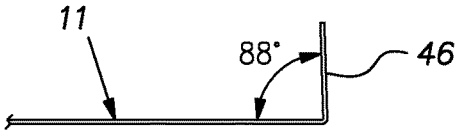
FIG. 10 is a typical cross-sectional view of an edge of the panels of FIGS. 8 and 9.

The panels 11 are typically made of sheet metal such as aluminum. The panels are bent up at their edges to provide sidewalls or sides 46 that stiffen the panel. A panel 11, inward of its sides 46 is ordinarily flat and made be perforated to afford sound absorption characteristics. All of the panel sides 46 are preferably over-bent to an angle, with reference to the panel center, of 88 degrees, for example, as shown in FIG. 10.

Figure 11:
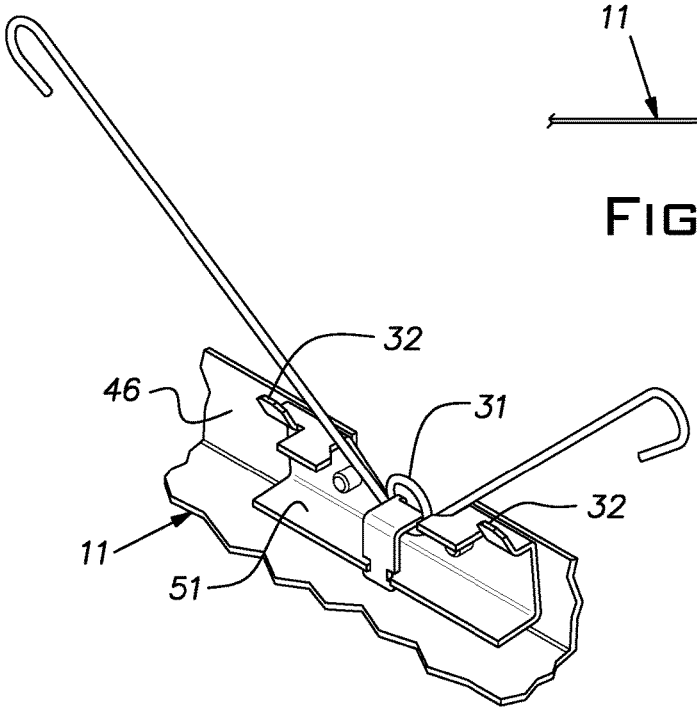
FIG. 11 is a fragmentary perspective view of a panel with a torsion spring clip with integral locating tabs and assembled with a torsion spring.

Sides of the panels 11 that extend between the sides 46 associated with the nominal width of the panel are fitted on their interiors with clips 51, two per side (FIG. 11). The clips 51, which are riveted or otherwise fastened to a panel side 46, each carry a torsion spring 31 and provide a pair of integral alignment tabs 32. The clips 51 and torsion springs 32, as well as their functions, are known, for example, from U.S. Pat. No. 9,228,347.

The panels 11 are arranged beneath the grid formed by the tees 12 and bars 13 so that the torsion springs are aligned with the torsion spring locations 17 of the bars 13. Referring to the plan view of FIG. 5, each spring location 17 of a bar 13 has apertures 56, 57, respectively, to receive the torsion spring and the alignment or locating tab pair of each clip 51 of two side-by-side panels 11 underlying the bar. The square apertures 57 are configured to accurately locate the tabs 32, and therefore an associated panel 11, longitudinally and laterally on the respective bar 13. The elongated apertures or slots 56 receive the arms of the torsion springs 31 allowing the springs to draw a panel side up against the bar 13 and allow the panel to be manually pulled down, against the force of the spring, away from the bar for access to the plenum above the ceiling 10.

Figure 5:
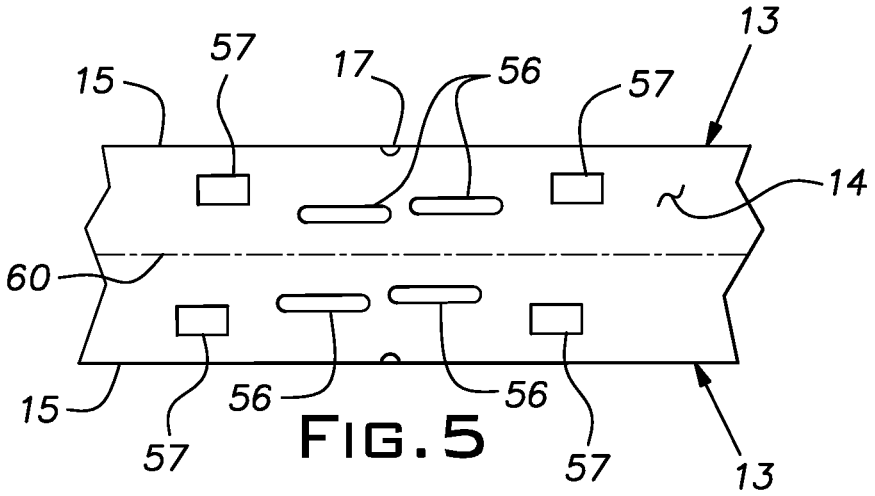
FIG. 5 is a fragmentary plan view on an enlarged scale showing details of apertures for springs and locating tabs at a typical spring center of the long and short bars.

Close inspection of FIG. 5 reveals that a set of the apertures 56, 57 for one panel, i.e. a set to one side of a longitudinal center line 60 of the web 14 of a bar 13 is longitudinally offset from the other set. It has been discovered that this offset adjustment allows adjacent panels to accurately align at the edges of their lower faces.

Where the panel acute angle is, for example, 52 degrees and the lateral spacing between the tab receiving apertures 57, i.e. between apertures on opposed sides of a longitudinal center of the bar web, is 0.688 inches, the longitudinal offset can be 0.146 inch. This offset is evenly split longitudinally between each aperture set from a specified center of the spring location 17 on the longitudinal center line 60 of the bar web 14. The offset is in a direction where a line drawn between mid-points of adjacent apertures 57 for tabs of adjacent panels tends to be aligned with the direction of those panel edges without springs.

The pattern of panels of FIG. 1 can be extended laterally and/or longitudinally or without any such extension can be repeated laterally.

Different ceiling aesthetics can be achieved with variations in the position of the tees 12 from a common single horizontal plane. For example, tees 12 on opposite sides of an intermediate tee 12 can be at a lower or a higher horizontal plane giving the ceiling a concave or a convex appearance from below. In such instances, the 88 degree over-bend of the panel sides or sidewalls 46 of the panels 11 avoid unsightly gaps at the panel edges. Still further, the tees 12 can be arranged to rise and fall at prescribed nodes where the tees are partially cut while leaving their flanges 24 intact but otherwise acting as a hinge. In these situations, the bars 13 are arranged to follow the local elevations of the tees 12 to which they are fixed.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended ceiling system comprising a plurality of spaced parallel main runners, a plurality of spaced parallel panel support bars intersecting and being fixed to the main runners at an oblique angle, a plurality of rhomboidal panels having angles equal to said oblique angle suspended from the support bars, the panels having nominal width dimensions that are equal to or whole fractions of a distance between adjacent runners, the panels having opposed first edges extending perpendicularly to a direction in which a width of a respective said panel is measured and opposed second parallel edges extending in a direction that is at said oblique angle relative to a direction that the first edges extend, the second panel edges underlying respective support bars and having attached torsion springs received in slots formed in the support bars.

2. The suspended ceiling system as set forth in claim 1, wherein said panels and bars are provided with right and left hand versions and are arranged in a chevron configuration.

3. The suspended ceiling system as set forth in claim 1, wherein said oblique angle is 52 degrees.

4. The suspended ceiling system as set forth in claim 1, wherein bars on opposite sides of a runner are aligned with a splice plate, the splice plate having an open slot assembled over and receiving a portion of the associated runner.

5. The suspended ceiling system as set forth in claim 1, wherein the panels have locating tabs adjacent each torsion spring and the bars have a receiving slot for receiving and accurately locating said tab and panel in longitudinal and lateral directions.

6. The suspended ceiling system as set forth in claim 1, wherein said main runners have a cross-section in the form of an inverted tee.

7. The suspended ceiling system as set forth in claim 1, wherein the panels are provided in two sizes, the panels of both sizes having the same width.

8. The suspended ceiling system as set forth in claim 1, wherein said panels are formed of sheet metal, marginal areas of the panels being bent upwardly to provide the panels with a pan shape.

9. The suspended ceiling system as set forth in claim 1, wherein said bars are U-shaped channels, said bars having spring reception areas with slots for receiving torsion springs of adjacent panels.

10. The suspended ceiling system as set forth in claim 9, wherein said bars are elongated elements and have spring receiving areas with slots for receiving torsion spring of adjacent panels, a torsion spring receiving slot associated with one of said adjacent panels being longitudinally offset from a corresponding torsion spring receiving slot associated with another of said adjacent panels.

11. The suspended ceiling system as set forth in claim 9, wherein the runners have an inverted T-shape with a lower flange, the bar channel having a web and two spaced upstanding flanges, ends of the bars being slotted whereby portions of bar flanges overlie the runner flanges and portions of the web underlie the runner flanges.

* * * * *